US009078531B1

(12) United States Patent
Medawar

(10) Patent No.: US 9,078,531 B1
(45) Date of Patent: Jul. 14, 2015

(54) DISPLAY CASE SAFE

(76) Inventor: Samuel C. Medawar, Lansing, MI (US)

( * ) Notice: Subject to any disclaimer, the term of this patent is extended or adjusted under 35 U.S.C. 154(b) by 0 days.

(21) Appl. No.: 13/245,415

(22) Filed: Sep. 26, 2011

Related U.S. Application Data

(60) Provisional application No. 61/386,707, filed on Sep. 27, 2010.

(51) Int. Cl.

| | |
|---|---|
| ***A47F 3/00*** | (2006.01) |
| ***A47B 81/00*** | (2006.01) |
| ***A47B 51/00*** | (2006.01) |
| ***E05G 1/00*** | (2006.01) |

(52) U.S. Cl.
CPC ..... *A47F 3/002* (2013.01); *A47B 51/00* (2013.01); *A47B 81/00* (2013.01)

(58) Field of Classification Search
CPC ..... A47F 3/002; A47F 3/00; A47F 3/06; A47B 51/00; A47B 81/00
USPC ..... 312/114, 306, 312, 319.5–319.8; 108/147, 145; 109/45, 49, 56, 57, 73
See application file for complete search history.

(56) References Cited

U.S. PATENT DOCUMENTS

| | | | | |
|---|---|---|---|---|
| 636,445 | A * | 11/1899 | McCabe et al. | 187/269 |
| 3,203,670 | A * | 8/1965 | Farris | 254/122 |
| 3,216,776 | A * | 11/1965 | Carbary | 312/296 |
| 4,568,132 | A * | 2/1986 | Watt | 312/312 |
| 5,273,352 | A * | 12/1993 | Saper | 312/7.2 |
| 5,727,655 | A * | 3/1998 | Pitman | 187/211 |
| 5,733,021 | A * | 3/1998 | O'Neill et al. | 312/114 |
| 6,412,890 | B1 * | 7/2002 | Kaneko et al. | 312/117 |
| 6,585,214 | B1 * | 7/2003 | Dittmer | 248/370 |
| 6,851,770 | B2 * | 2/2005 | Canedy et al. | 312/114 |
| 2006/0076860 | A1 * | 4/2006 | Hoss | 312/312 |
| 2006/0102812 | A1 * | 5/2006 | Cvek | 248/125.2 |
| 2007/0194674 | A1 * | 8/2007 | Salter | 312/312 |
| 2008/0079337 | A1 * | 4/2008 | Vardaro et al. | 312/138.1 |
| 2008/0174215 | A1 * | 7/2008 | Amstutz et al. | 312/117 |
| 2009/0039743 | A1 * | 2/2009 | Gevaert | 312/223.2 |
| 2010/0039006 | A1 * | 2/2010 | Lawrence et al. | 312/128 |

FOREIGN PATENT DOCUMENTS

| | | | | |
|---|---|---|---|---|
| EP | 0521728 | A1 * | 1/1993 | A47F 3/00 |

* cited by examiner

*Primary Examiner* — Daniel J Troy
*Assistant Examiner* — Andrew Roersma
(74) *Attorney, Agent, or Firm* — The Weintraub Group, L.L.C.

(57) ABSTRACT

A display case for easily moving items on display to a safe. The display case includes a first display portion and a second safe portion. The front and back walls of the second safe portion have first upper panels which pivot to form the top wall of the safe. A lift mechanism is mounted in the second safe portion to move the items from the display position to the stored, safe position inside the second safe portion. A control system controls the first upper panels and the lift mechanism.

22 Claims, 7 Drawing Sheets

DISPLAY CASE SAFE

CROSS REFERENCES TO RELATED APPLICATIONS

This application claims the benefit of U.S. Provisional Application No. 61/386,707, filed on Sep. 27, 2010 which is hereby incorporated herein by reference in its entirety, except that the present application supersedes any portion of the above referenced application which is inconsistent with the present application.

STATEMENT REGARDING FEDERALLY SPONSORED RESEARCH OR DEVELOPMENT

Not Applicable

BACKGROUND OF THE INVENTION

Field of the Invention

The present invention relates to a display case which includes a built-in storage safe. In particular, the present invention relates to a combination display case and storage safe which stores items displayed in the display case in a safe which is part of the display case when the items are not on display.

BRIEF SUMMARY OF THE INVENTION

A display case for easily moving items on display to a safe. The display case includes a first display portion and a second safe portion. The first and second portions of the display case are connected together. The first display portion is constructed of a transparent material to enable viewing of the items when on display in the display case. The second safe portion includes front and back walls and sidewalls extending therebetween and a floor. The front and back walls of the second safe portion are constructed of first upper panels and second lower panels. The second lower panels are stationary and form the front and back walls of the safe. The first upper panels pivot on the second lower panels so that in the closed position when the first upper panels are perpendicular to the second lower panels, the first upper panels form the top wall of the safe. In the open position, the first upper panels are essentially aligned with the second lower panels and form a portion of the front and back wall of the display case between the second lower panels and the first display portion.

Opening mechanisms are connected to the inner side edges of the first upper panels to move the first upper panels between the open and closed positions. A lift mechanism is mounted in the second safe portion to move the display platform from the display position adjacent the first display portion of the display case to the stored, safe position inside the second safe portion. The display platform remains level during raising and lowering to prevent disturbing the items. The opening mechanisms and lift mechanism are controlled by a control system. The control system in one (1) embodiment is activated by a key. The control system has limit switches so that the opening mechanism and lift mechanism are activated and deactivated at the correct time. The first upper panels can also be provided with locks which are controlled by the control system.

To move items on display on the display platform to a secure location in the safe formed by the second safe portion of the display case, the control system is activated which activates the lift mechanism to lower the display platform.

When the lift mechanism is in the fully lowered position with the display platform fully within the second safe portion, a limit switch of the control system is activated which deactivates the lift mechanism and activates the opening mechanisms. The opening mechanisms pivot the first upper panels into the closed position so that the first upper panels extend across a top of the second safe portion and form the top wall of the safe. In the one (1) embodiment where a lock is provided, when the opening mechanisms reach the fully closed position, a limit switch of the control system is activated which activates the lock to lock the first upper panels in the closed position. To re-display the items, the key switch is rotated and the opening mechanisms are activated. In the one (1) embodiment having a lock, the lock is deactivated before the opening mechanisms are activated. The opening mechanisms pivot the first upper panels from the closed position to the open position. When the opening mechanisms reach the fully open position, limit switches are activated to deactivate the opening mechanisms and activate the lift mechanism. The lift mechanism raises the display platform to the display position adjacent the first display portion of the display case. Once the items are on display the control system deactivates the lift mechanism.

The present invention relates to a display case which comprises a first display portion, a second safe portion connected to the first display portion and having a first wall and a second wall with opposed sidewalls extending therebetween, the first and second walls each including a first panel pivotably attached to a second panel, an opening mechanism attached to the first panels for moving the first panels between a closed position essentially perpendicular to the second panels and an open position essentially aligned with the second panels, a lift mechanism mounted in the second display portion, a display platform connected to the lift mechanism, and a control system for controlling the opening mechanism and the lift mechanism.

Further, the present invention relates to a method for moving items on display to a safe, which comprises the steps of providing a display case having a first portion and a second portion connected to the first portion, the second portion having opposed first and second walls with sidewalls extending therebetween, the first and second walls each having a first panel pivotably attached to a second panel with an opening mechanism connected to the first panels for pivoting the first panels between an open position and a closed position, providing a lift mechanism mounted in the second portion, providing a display platform connected to the lift mechanism for displaying the items, providing a control system for operating the opening mechanism and the lift mechanism, and activating the control system to activate the lift mechanism to lower the display platform with the items to a fully lowered position in the second portion and activating the opening mechanism to pivot the first panels to the closed position essentially perpendicular to the second panels such that the first panels form a top wall of the second portion of the display case and so that the walls of the second portion form the safe and the display platform with the items is located in the safe.

Still further, the present invention relates to a method moving items from a safe to a display, which comprises the steps of providing a display case having a first portion and a second portion connected to the first portion, the second portion having opposed first and second walls with sidewalls extending therebetween, the first and second walls each having a first panel pivotably attached to a second panel, an opening mechanism connected to the first panels, a display platform for holding the items mounted in the second portion, a lift mechanism connected to the display platform and mounted in the second portion, and a control system for operating the opening mechanism and the lift mechanism wherein when the items are in the safe, the first panels are in a closed position essentially perpendicular to the second panels such that the first panels form a top wall of the second portion and the safe and the lift mechanism is in a fully lowered position, and activating the control system to activate the opening mechanism to pivot the first panels to a fully, open position essentially aligned with the second panels such that the first panels form a section of the first and second walls extending between the first portion and the second portion of the display case and to activate the lift mechanism to raise the display platform with the items to a fully extended, display position so that the display platform with the items is adjacent the first portion and the items are on display.

The substance and advantages of the present invention will become increasingly apparent by reference to the following drawings and the description.

DETAILED DESCRIPTION OF THE INVENTION

Figure 1:
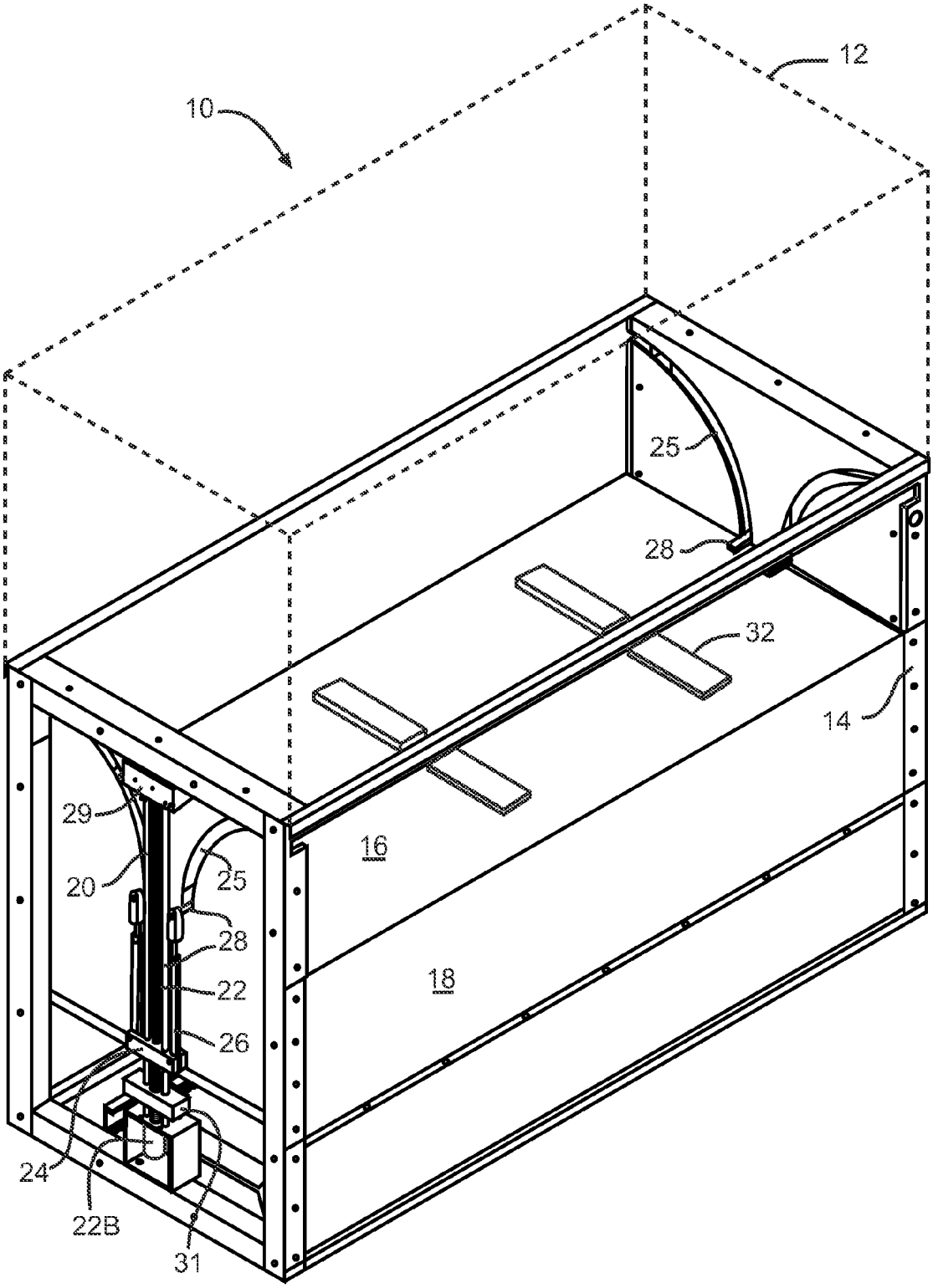
FIG. 1 is a perspective side view of the display case 10 of the present invention with the upper panels 16 in the fully retracted, stored position.

The display case 10 of the present invention includes a first display portion 12, a second safe portion 14, a lift mechanism 34 with a display platform 56, opening mechanisms 20 for moving upper panels 16 and a control system. The first display portion 12 allows for viewing the items in the display case 10 and includes a front wall and back wall with opposed sidewalls extending therebetween and a top wall. In one (1) embodiment, the walls of the first display portion 12 are constructed of a transparent material such as glass to allow for viewing items in the display case 10.

The second safe portion 14 of the display case 10 forms the safe of the display case 10. The second safe portion 14 includes a front wall, a back wall, opposed sidewalls extending therebetween and a bottom wall. In one (1) embodiment, the walls of the second safe portion 14 of the display case 10 are constructed of steel. The display platform 56 mounted on the lift mechanism 34 provides the floor for the first display portion 12 of the display case 10 and the top of the second safe portion 14 when the items are on display and the second safe portion 14 of the display case 10 is not being used as a safe.

The control system for the display case 10 includes a key valve 62, a power source (not shown), first, second, third, fourth and fifth limit switches 64, 66, 68, 70 and 72, and a circuit board 74. The control system controls the opening mechanisms 20 for the upper panels 16, the activation cylinders 54 of the lift mechanism 34 and the locks 32. The control system controls the systems and mechanisms of the display case 10 as used to move the items in the display case 10 to and from the stored, safe position to the display position. In one (1) embodiment, the circuit board 74 of the control system is located on the floor of the second safe portion 14 of the display case 10.

The front and back walls of the second safe portion 14 of the display case 10 each include an upper panel 16 and a lower panel 18. The upper panels 16 are pivotably attached along the bottom edge to the stationary lower panels 18. The upper panels 16 pivot between an open position with the upper panels 16 essentially aligned with the lower panels 18 and a closed position with the upper panels 16 essentially perpendicular to the lower panels 18 so that the upper panels 16 extend across the top of the second safe portion 14 of the display case 10. The size of the upper panels 16 is such that in the fully open position, the upper panels 16 completely fill the space between the top of the lower panels 18 and the first display portion 12 of the display case 10 and in the fully closed position, the upper panels 16 completely fill the space between the front and back walls and the sidewalls of the second safe portion 14 and form a secure top for the safe.

Figure 3:
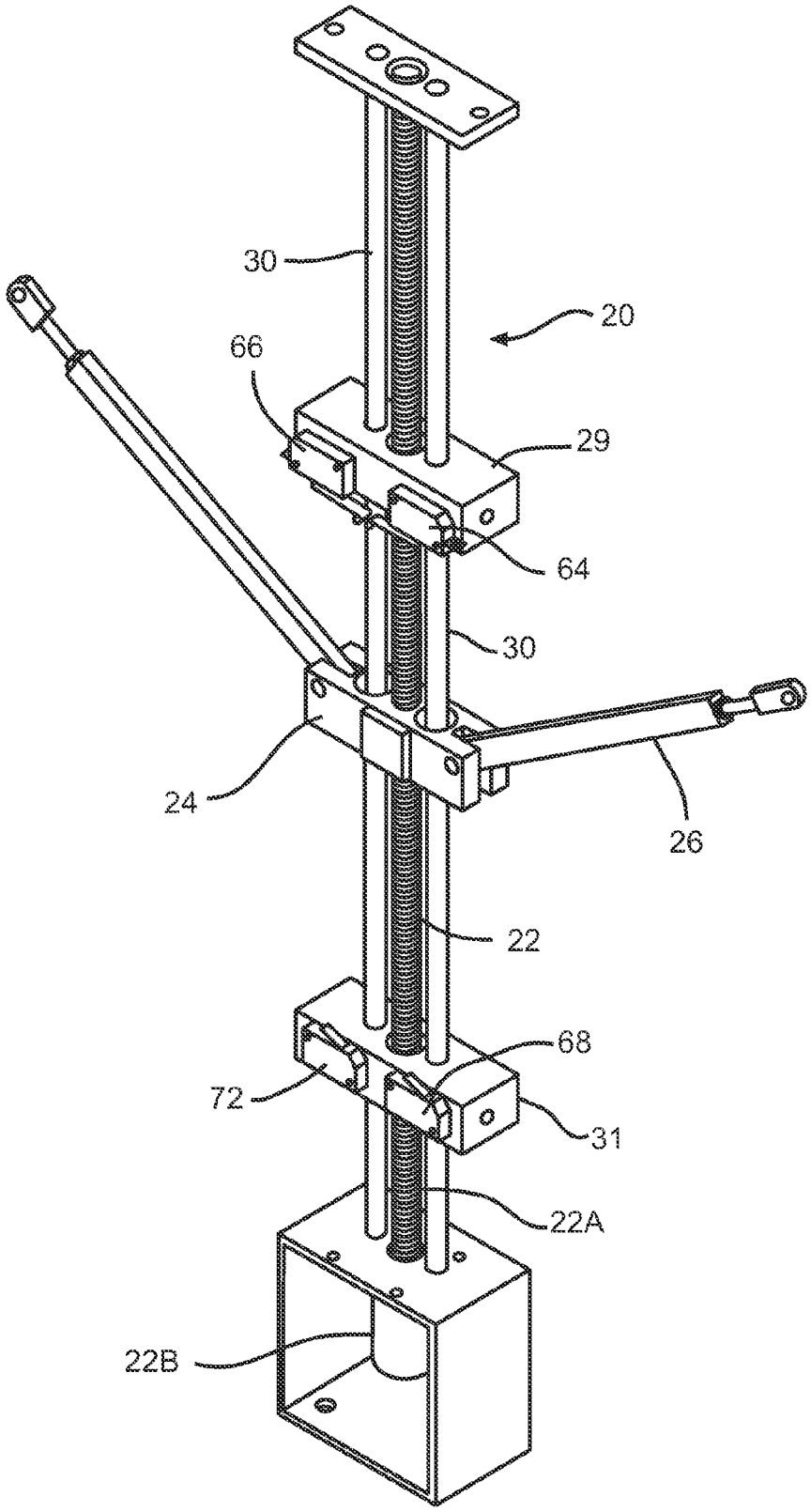
FIG. 3 is a inner side perspective view of the opening mechanism for the right side, upper panel 20 showing the arms 26, and the first, second and third limit switches 64, 66 and 68.

A pair of right and left side opening mechanisms 20 are mounted adjacent each of the sidewalls of the second safe portion 14. The right and left side opening mechanisms 20 are essentially identical. Therefore, only the right side opening mechanism 20 will be described in detail (FIG. 3). The right side opening mechanism 20 includes a drive mechanism 22 having a sliding block 24 with a pair of arms 26 pivotably attached at the first ends to the sliding block 24. The second ends of the arms 26 are attached by pins 28 to the upper panels 16. The sidewalls of the second safe portion 14 are provided with a pair of grooves 25 adjacent the opening mechanisms 20. The pins 28 extend from the second ends of the arms 26 through the grooves 25 in the sidewall of the second safe portion 14 to the inner edges of the upper panels 16. As the sliding block 24 moves, the pins 28 move along the grooves 25 to pivot the upper panels 16 between the open and closed positions. In one (1) embodiment, the drive mechanism 22 for the opening mechanism 20 is a screw drive. In this embodiment, the sliding block 24 moves along the screw 22A of the screw drive as the screw 22A is rotated by a motor 22B. Guide rods 30 are mounted on either side of the screw 22A of the screw drive and extend through the sliding block 24 to keep the sliding block 24 in position and prevent the sliding block 24 from rotating as the screw 22A rotates. The drive mechanism 22 also includes an upper block 29 spaced above the sliding block 24 and a lower block 31 spaced below the sliding block 24. The first and second limit switches 64 and 66 of the control system are mounted on the upper block 29 of the drive mechanism 22 located adjacent to a top of the second safe portion 14. The first and second limit switches 64 and 66 are activated when the sliding block 24 moves adjacent to the upper block 29 and contacts the first and second limit switches 64 and 66. When the sliding block 24 is in the top most position, the upper panels 14 are in the fully open position. In one (1) embodiment, the first and second limit switches 64 and 66 are located on both the right and left side opening mechanisms 20. However, it is understood that a single set of first and second limit switches 64 and 66 can be used. The third and fifth limit switches 68 and 72 of the control system are mounted on the lower block 31 of the drive mechanism 22. The third and fifth limit switches 68 and 72 are activated when the sliding block 24 moves adjacent to the lower block 31 and contacts the third and fifth limit switches 68 and 72. When the sliding block 24 is in the lower most position, the upper panels 16 are in the fully closed position. In one (1) embodiment, only one third limit switch 68 and one fifth limit switch 72 is used on the lower block 31 of the drive mechanism 22 of one of the opening mechanisms 20. However, it is understood that a third limit switch 68 and a fifth limit switch 72 can be provided on both opening mechanisms 20. In one (1) embodiment, the limit switches 64, 66, 68, 70 and 72 are essentially identical. However, it is understood that any type of limit switch can be used. In one (1) embodiment, the limit switches 64, 66, 68, 70 and 72 are located on an inner side of the opening mechanism 20 adjacent the sidewalls of the second safe portion 14. However, it is understood that the limit switches 64, 66, 68, 70 and 72 can also be located on a side of the opening mechanism 20 opposite the sidewall.

Locks 32 are provided on the upper panels 16 which lock the upper panels 16 in the fully closed position. In one (1) embodiment, the locks 32 are mounted on the top surface of the upper panels 16 adjacent the inner edges of the upper panels 16. In one (1) embodiment, the locks 32 include a sliding bar mounted on one of the upper panels 16 and a tube located on the other upper panel 16. To lock the upper panels 16 in the closed position, the sliding bar is moved into the tube. However, it is understood that the locks 32 can be of any type well known in the art.

Figure 4:
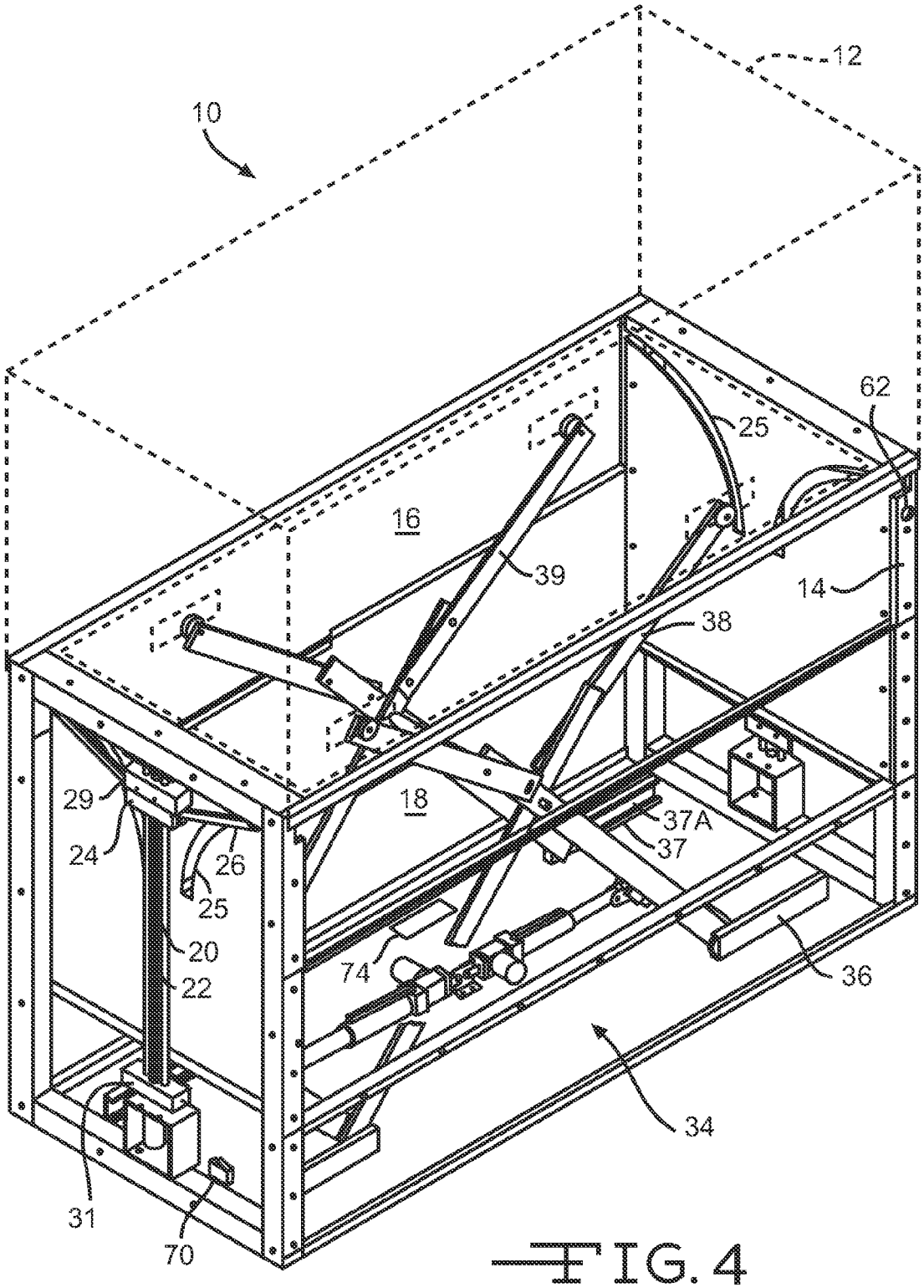
FIG. 4 is a perspective side view of the display case 10 without the front upper panel 16 and with the display platform 56 in phantom showing the lift mechanism 34 in the fully, raised position.

The lift mechanism 34 is mounted in the second safe portion 14 of the display case 10 (FIG. 4). The lift mechanism 34 can be any mechanism well known in the art for lifting a platform parallel to a ground surface. In one (1) embodiment, the lift mechanism 34 is pneumatically operated. However, the lift mechanism 34 can be operated by any well known means such as for example hydraulic or electric.

Figure 2:
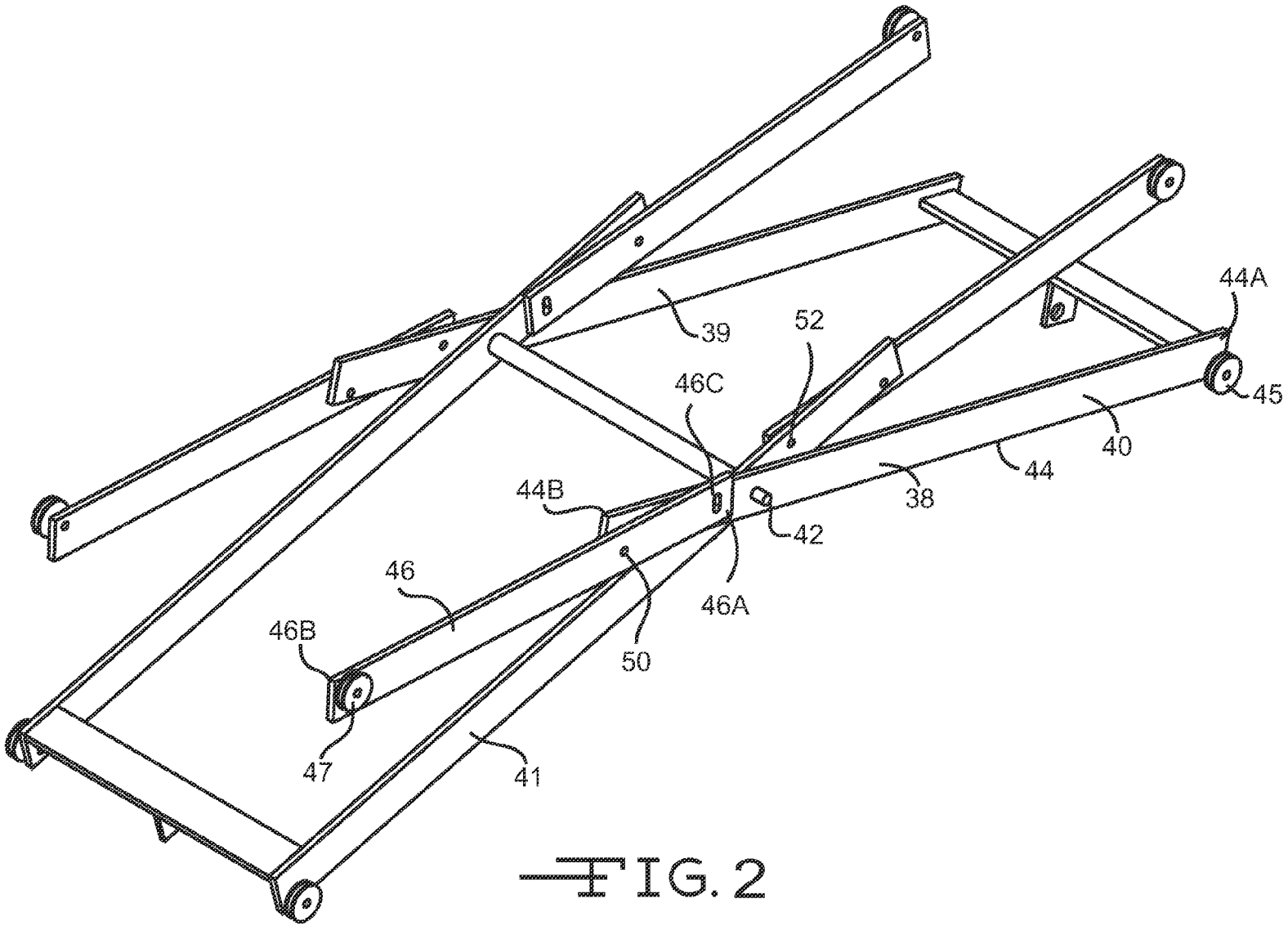
FIG. 2 is a perspective side view of the lift mechanism 34 in the slightly raised position without the display platform 56 and without the actuation cylinders 54.
Figure 2A:
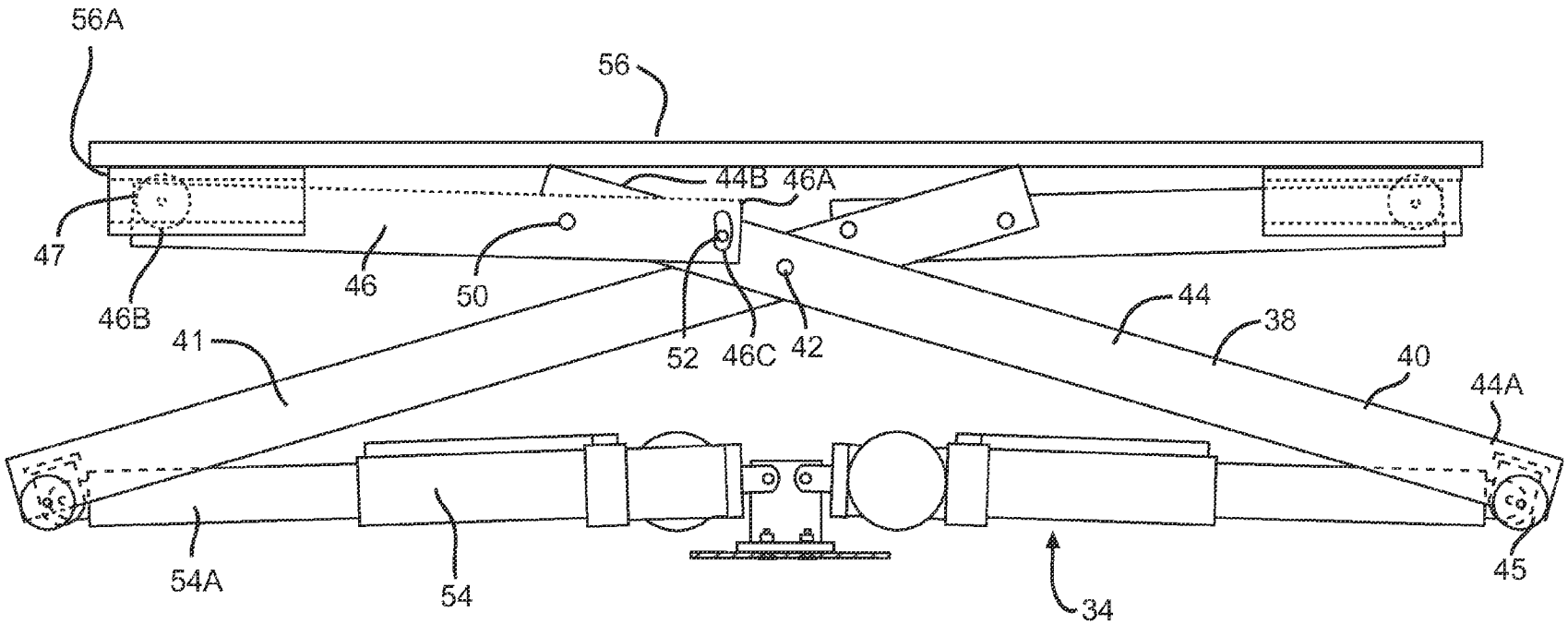
FIG. 2A is a side view of the lift mechanism 34 in the slightly raised position showing the display platform 56 on the rollers 47.

In one (1) embodiment, the lift mechanism 34 includes floor rails 36 and 37, lifting arms 38 and 39 and activation cylinders 54. In one (1) embodiment, the floor rails 36 and 37 of the lift mechanism 34 include four (4) floor rails spaced adjacent each of the corners of the second safe portion 14 of the display case 10. In one (1) embodiment, the floor rails 36 and 37 extend parallel to the front and back walls of the second safe portion 14 of the display case 10. In one (1) embodiment, the floor rails 36 and 37 have grooves or tracks 37A on the inner surface on a side opposite the front or back walls of the second safe portion 14 of the display case 10. In one (1) embodiment, the floor rails 36 and 37 are c-channels. The fourth limit switch 70 of the control system is mounted adjacent one (1) of the sidewalls of the second safe portion 14 spaced between the front and back floor rails 36 and 37 (FIG. 4). The lifting arms 38 and 39 include a front lifting arm 38 and a back lifting arm 39 (FIGS. 2 and 2A). The front and back lifting arms 38 and 39 are connected together so that the front and back lifting arms 38 and 39 act in unison. The front and back lifting arms 38 and 39 are essentially identical. Therefore, only the front lifting arm 38 will be described in detail. The front lifting arm 38 includes a first lift arm 40 and a second lift arm 41. The first and second lift arms 40 and 41 of the front lifting arm 38 are pivotably connected together by a first pivot pin 42. In one (1) embodiment, the first pivot pin 42 for the front lifting arm 38 is also the first pivot pin 42 for the back lifting arm 39. The first and second lift arms 40 and 41 of the front lifting arm 38 are essentially identical. Therefore, only the first lift arm 40 will be described in detail. The first lift arm 40 includes a first link 44 and a second link 46 pivotably connected together. The first end 44A of the first link 44 is slidably mounted in one of the floor rails 36 located adjacent one of the sidewalls of the second safe portion 14 of the display case 10. The first end 44A of the first link 44 is provided with a roller or wheel 45 which moves along the track 37A of the floor rail 36. The first ends 44A of the first links 44 of the first and second lift arms 40 and 41 of the front lifting arm 38 are connected by first and second connection bars 48 and 49 respectively to the first ends 44A of the first links 44 of the first and second lift arms 40 and 41 of the back lifting arm 38 (FIG. 2). The first link 44 extends from the floor rail 36 toward the center of the second safe portion 14 of the display case 10 to the second end 44B of the first link 44. The second end 44B of the first link 44 is pivotably connected to the first end 46A of the second link 46. The first and second links 44 and 46 are pivotably connected together by a second pivot pin 50 extending through the second end 44B of the first link 44 and through a portion of the second link 46 spaced apart from the first end 46A of the second link 46. The first pivot pin 42 for the first and second lift arms 40 and 41 is spaced between the second pivot pin 50 and the first ends 44A of the first links 44 of the first and second lift arms 40 and 41. The second link 46 has a slot 46C spaced between the second pivot pin 50 and the first end 46A of the second link 46. A third pivot pin 52 extends from the first link 44, spaced apart from the second end 44B of the first link 44 and engages the slot 46C of the second link 46. The second and third pivot pins 50 and 52 of the first and second links 44 and 46 allow the second link 46 to pivot slightly on the first link 44. In one (1) embodiment, the second link 46 of the first lift arm 40 is mounted on an inner side of the first link 44 on a side opposite the front wall of the second safe portion 14 of the display case 10 and the second link 46 of the second lift arm 41 is mounted on an outer side of the first link 44 adjacent the front wall of the second safe portion 14 of the display case 10 on the side opposite the first link 44 of the first lift arm 40.

In one (1) embodiment, the lift mechanism 34 includes a pair of activation cylinders 54 (FIG. 2A). The activation cylinders 54 are mounted adjacent the floor of the second safe portion 14 between the front and back lifting arms 38 and 39. In one (1) embodiment, the first activation cylinder 54 is attached to the first connection bar 48 connecting the first ends 44A of the first links 44 of the first lift arms 40 of the front and back lifting arms 38 and 39 together and the second activation cylinder 54 is attached to the second connection bar 49 connecting the first ends 44A of the first links 44 of the second lift arms 41 of the front and back lifting arms 38 and 39 together. In one (1) embodiment, the activation cylinders 54 operate by extending and contracting a piston 54A. In one (1) embodiment, the activation cylinders 54 are a multi-powered cylinder. In one (1) embodiment, the activation cylinders 54 are a multi-powered cylinder manufactured by Fabco-air.

The display platform 56 is mounted on the second ends 46B of the second links 46 of the first and second lift arms 40 and 41 of the front and back lifting arms 38 and 39 of the lift mechanism 34. Rails 56A are mounted on an underneath side of the display platform 56 along the front and back edges of the display platform 56 (FIG. 2A). In one (1) embodiment, the rails 56A are C-channels similar to the floor rails 36 and 37. The second ends 44B of the second links 44 of the first and second lift arms 40 and 41 of the front and back lifting arms 38 and 39 have rollers or wheels 47 which engage the rails 56A on the underneath side of the display platform 56. In one (1) embodiment, the display platform 56 has an essentially rectangular shape. In one (1) embodiment, the display platform 56 has an essentially flat top surface. The display platform 56 can be constructed of any material well-known in the art.

To raise and lower the display platform 56, the pistons 54A of the activation cylinders 54 of the lift mechanism 34 are extended and contracted which raises and lowers the lift mechanism 34. To raise the display platform 56 from the fully lowered position, the pistons 54A of the activation cylinders 54 are contracted. As the pistons 54A contract, the connection bars 48 and 49 connected to the pistons 54A are pulled or moved inward toward the center of the display case 10 so that the first ends 44A of the first links 44 of the lift arms 40 and 41 move along the floor rails 36 and 37 toward the center of the second safe portion 14 of the display case 10. As the first ends 44A of the first links 44 move inward, the second ends 44B of the first links 44 pivot upward and the second ends 46B of the second links 46 move along the rails 56A on the underneath side of the display platform 56 toward the center of the display platform 56. The pivotable connection of the first and second links 44 and 46 enable the second links 46 to move and pivot such that the display platform 56 remains level as the display platform 56 is raised.

To lower the display platform 56, the pistons 54A of the activation cylinder 54 are extended which pushes the connection bars 48 and 49 and the first ends 44A of the first links 44 toward the sidewalls of the second safe portion 14 of the display case 10 which pivots the second ends 44B of the first links 44 down. As the first links 44 pivot down, the second ends 46B of the second links 46 move along the rails 56A of the display platform 56 toward the outer edges of the display platform 56. When the lift arms 40 and 41 of the lift mechanism 34 are in the fully lowered, stored position, the second connection bar 49 contacts the fourth limit switch 70 which deactivates the lift mechanism 34 and activates the opening mechanisms 20 to close the upper panels 16.

Figure 5:
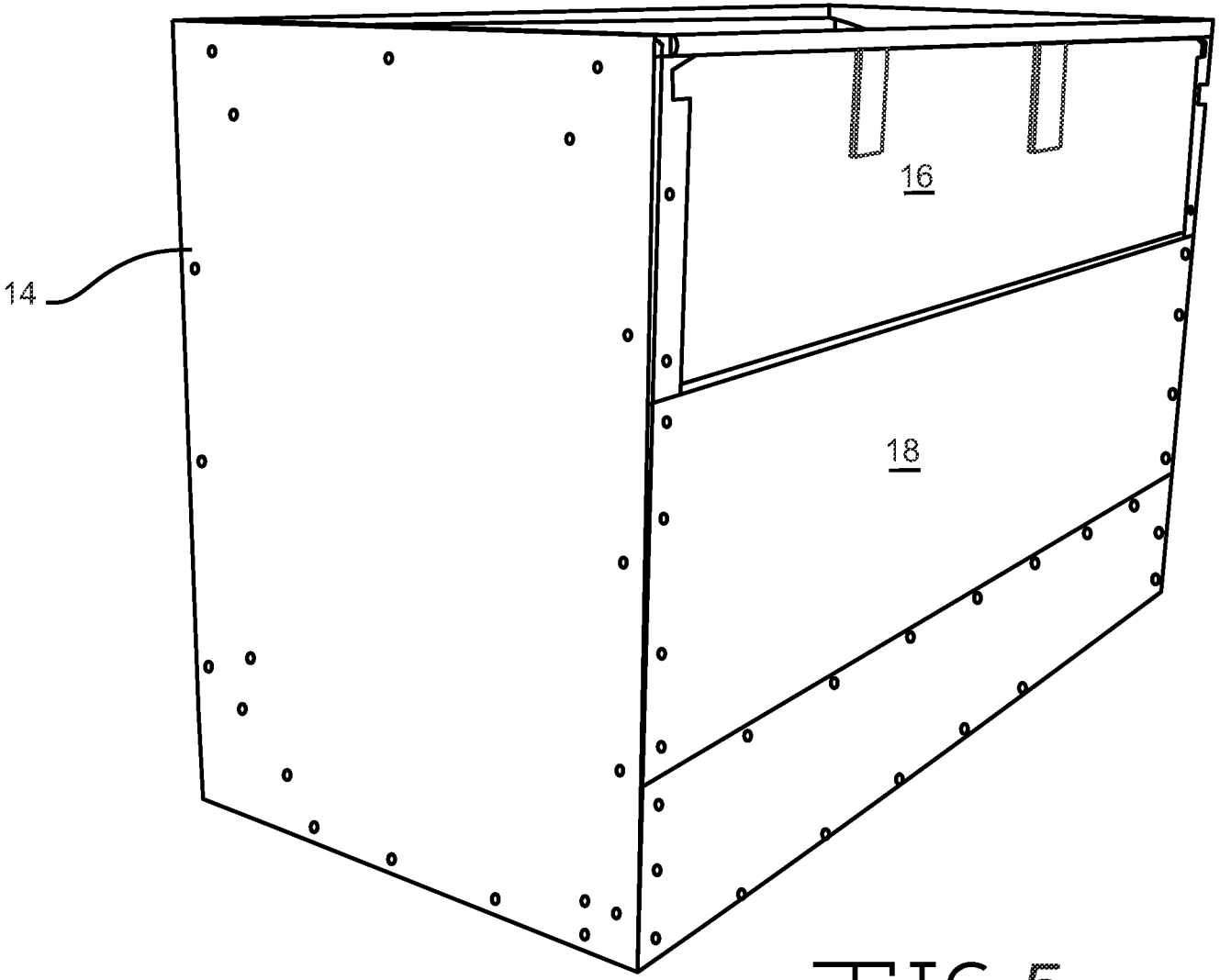
FIG. 5 is a perspective side view of the display case 10 without the first display portion 12 showing the upper panels 16 in the fully open position.
Figure 6:
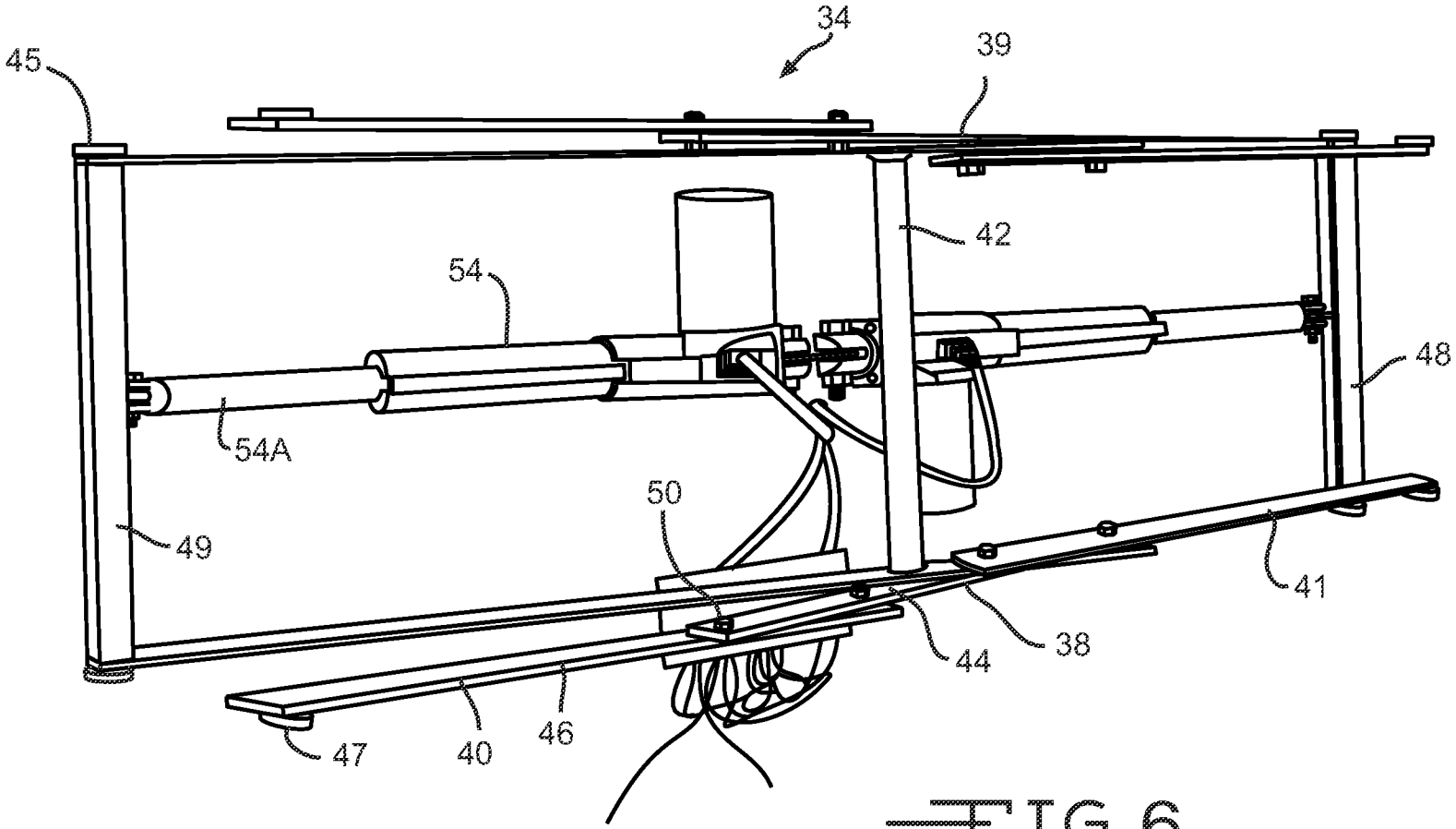
FIG. 6 is a top view of the lift mechanism 34 in the fully retracted lowered position showing the activation cylinders 54.

In use, when the display case 10 is in the display position, the upper panels 16 are in the fully, open position and the lift mechanism 34 is in the fully extended, display position (FIG. 5). To move the display platform 56 to the safe, the key switch 62 of the control system is activated. The key switch 62 can be activated either manually or remotely. In one (1) embodiment, the key switch 62 is activated by rotating a key. In one (1) embodiment, where the control system is pneumatically operated, the key switch 62 controls a pair of power valves (not shown) which control the flow of air. In one (1) embodiment, the key switch 62 is a three (3) position switch having an "up" "down" and "off" position. In one (1) embodiment, the direction the key switch 62 is rotated determines whether the display platform 56 is raised or lowered. In one (1) embodiment, the key switch 62 can only be rotated in one (1) direction depending on the position of the display platform 56. In one (1) embodiment, the key switch 62 is rotated to the "down" position to move the display platform 56 to the stored, safe position. Once the control system is activated, the activation cylinders 54 of the lift mechanism 34 are activated so that the pistons 54A of the activation cylinders 54 extend which slowly lowers the display platform 56. The angle and position of front and back lifting arms 38 and 39 of the lift mechanism 34 during raising and lowering of the display platform 56 ensures that the display platform 56 remains level during the raising and lowering process. As the display platform 56 is lowered, the display platform 56 slides on the rollers 47 on the second ends 46B of the second links 46 of the first and second lift arms 40 and 41 to allow the display platform 56 to remain in the opening of the display case 10. In one (1) embodiment, the sides of the display platform 56 have rollers or bumpers and the display platform 56 moves freely on the lift mechanism 34 so that as the display platform 56 is lowered, the contact of the display platform 56 with the walls of the second safe portion 14 of the display case 10 act to correctly position the display platform 56 in the opening. In the fully lowered position, the display platform 56 is completely within the second safe portion 14 of the display case 10 below the bottom edge of the upper panels 16. Once the display platform 56 is in the fully lowered position, the second connection bar 49 of the lift mechanism 34 contacts the fourth limit switch 70 which deactivates the activation cylinders 54 of the lift mechanism 34 and activates the opening mechanisms 20 for the upper panels 16. In one (1) embodiment, the drive mechanisms 22 of the opening mechanisms 20 rotate the screws 22A which move the sliding blocks 24 downward and pivot or pull the upper panels 16 downward. The upper panels 16 are pivoted downward until the upper panels 16 are in the fully closed position and fully cover the top of the second safe portion 14 of the display case 10. When the upper panels 16 are in the fully closed position, the sliding block 24 contacts the third limit switch 68 which activates the locks 32 to slide the sliding bars across the top of the upper panels 16 to lock the upper panels 16 in place. The upper panels 16, lower panels 18, sidewalls and the floor of the second safe portion 14 of the display case 10 form a secure safe in which the items on the display platform 56 can be stored.

To redisplay the items, the key switch 62 is rotated to the "up" position which instantly deactivates the locks 32 and then activates the opening mechanisms 20. The opening mechanisms 20 slowly move the sliding blocks 24 upward, moving the upper panels 16 to the open position. When the upper panels 16 reach the fully open position, the sliding blocks 24 contact the first limit switch 64 which deactivates the opening mechanisms 20 and contacts the second limit switch 66 which activates the activation cylinders 54 of the lift mechanism 34. It is understood that a single multi-purpose limit switch could be used in place of the first and second limit switches. The lift mechanism 34 then slowly raises the display platform 56 to the fully extended, display position. The lift mechanism deactivates automatically when the display platform 56 reaches the fully extended display position. In one (1) embodiment, the key switch is then rotated to the "off" position.

In the foregoing description, various features of the present invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are here by incorporated by reference herein in their entirety, with each claim standing on its own as a separate embodiment of the present invention.

It is intended that the foregoing description be only illustrative of the present invention and that the present invention be limited only by the hereinafter appended claims.

I claim:

1. A display case which comprises:

a) a first display portion having a top wall with an opposed bottom and opposed first sidewalls extending therebetween;

b) a second safe portion having a pair of opposed first walls and a pair of opposed second sidewalls extending between the first walls, each second sidewall having a pair of opposed curvilinear guide tracks, the second sidewalls having an upper end connected to the bottom of the first display portion, and the first walls having a top end spaced from the bottom of the display portion to form an opening therebetween, a panel pivotably attached to the top end of a respective first wall, the panels being movable between a closed position essentially perpendicular to the respective first wall and an open position essentially parallel with the respective first wall, each panel including a pin disposed in an associated guide track, the panels having a size essentially equal to a distance between the top end of the respective first wall and the bottom of the first display portion, wherein the panels are configured in the closed position to provide the opening between the top end of the first walls and the bottom of the first display portion of the display case, wherein the panels are configured in the open position to close the opening, wherein the guide tracks are provided above the top ends of the first walls;

c) an opening mechanism attached to the first panels for moving the first panels between the closed and open positions, and for enabling each pin to traverse its associated guide track;

d) a lift mechanism mounted in the second safe portion;

e) a display platform connected to the lift mechanism; and f) a control system for controlling the opening mechanism and the lift mechanism.

2. The display case of claim 1 wherein in a fully lowered position, the lift mechanism and the display platform are completely within the second safe portion.

3. The display case of claim 2 wherein in a fully raised position, the display platform is positioned at an intersection of the first display portion and the second safe portion and forms a top wall of the second safe portion and a bottom wall of the first display portion.

4. The display case of claim 1 wherein the display platform is of such a size as to move between the walls of the second safe portion and such as to essentially fill a space between the walls of the second safe portion.

5. The display case of claim 1 wherein the second safe portion has a floor extending between the walls with rails on the floor, wherein the lift mechanism includes lifting arms having first and second ends and wherein the first ends of the lifting arms have rollers which engage the rails on the floor of the second safe portion.

6. The display case of claim 5 wherein an underneath surface of the display platform has rails and wherein the second ends of the lifting arms of the lift mechanism have rollers which move in the rails of the display platform when the display platform is raised and lowered.

7. The display case of claim 1 wherein the control system includes limit switches and a key switch.

8. The display case of claim 1 wherein the size of the first panels is such that the first panels do not extend beyond the bottom of the first display portion in a direction toward the top wall of the first display portion.

9. A method for moving items on display to a safe, which comprises the steps of:

a) providing a display case having a first portion having a top wall with an opposed bottom and opposed first sidewalls extending therebetween and a second portion connected to the first portion, adjacent the bottom of the first portion opposite the top wall of the first portion, the second portion having opposed first and second walls with second sidewalls extending therebetween, each second sidewall having a pair of opposed curvilinear guide tracks, the first and second walls each having a first panel pivotably attached to a top end of a stationary second panel, each panel including a pin disposed in an associated guide track for enabling each pin to traverse its associated guide track, with an opening mechanism connected to the first panels for pivoting the first panels between an open position and a closed position, each first panel having a size essentially equal to a distance between the top end of the second panel to which it is attached and the bottom of the first portion, wherein the first panels are configured in the closed position to provide an opening spaced between the top end of the second panels and the bottom of the first portion of the display case, and in the open position to pivot and close the opening, wherein the guide tracks are provided above the top ends of the stationary second panels;

b) providing a lift mechanism mounted in the second portion;

c) providing a display platform connected to the lift mechanism for displaying the items;

d) providing a control system for operating the opening mechanism and the lift mechanism; and e) activating the control system to activate the lift mechanism to lower the display platform with the items to a fully lowered position in the second portion, and activating the opening mechanism to pivot the first panels to the closed position essentially perpendicular to the second panels such that the first panels form a top wall of the second portion of the display case, and so that the walls of the second portion form the safe, and the display platform with the items is located in the safe.

10. The method of claim 9 wherein the control system includes a first limit switch, wherein in step (e) when the lift mechanism reaches the fully lowered position, the first limit switch is activated which activates the opening mechanism.

11. The method of claim 9 wherein further in step (e), as the display platform is lowered, a surface of the display platform having the items remains parallel to a ground surface.

12. The method of claim 9 wherein a lock is provided on the first panels and wherein further in step (e), when the first panels are in the closed position, the control system activates the lock to lock the first panels in the closed position.

13. The method of claim 12 wherein the control system includes a second limit switch and wherein further in step (e) when the first panels are moved to the closed position, the second limit switch is activated which activates the lock to lock the first panels in the closed position.

14. The method of claim 9 wherein further in step (e), during pivoting, the first panels do not extend beyond the bottom of the first portion in a direction toward the top wall of the first portion.

15. A method for moving items from a safe to display, which comprises the steps of:

a) providing a display case having a first portion having a top wall with an opposed bottom and opposed first sidewalls extending therebetween, and a second portion connected to the first portion adjacent the bottom of the first portion and opposite the top wall of the first portion, the second portion having opposed first and second walls with second sidewalls extending therebetween, each second sidewall having a pair of opposed curvilinear guide tracks, the first and second walls each having a first panel pivotably attached to a top end of a respective stationary second panel, each first panel including a pin disposed in an associated guide track, each panel having a size essentially equal to a distance between the top end of the respective second panel and the bottom of the first portion, wherein the first panels are configured in an open position to be in substantially parallel relation with the second panels and form a closure of an opening extending between the top ends of the second panels and the bottom of the display portion, and each second panel is configured to pivot from the open position into a closed position to be in substantially perpendicular relation to the respective second panel to form a top wall of the second portion and provide the opening extending between the top ends of the second panels and the bottom of the first portion, an opening mechanism connected to the first panels for enabling each pin to traverse its associated guide track, a display platform for holding the items mounted in the second position, a lift mechanism connected to the display platform and mounted in the second portion, and a control system for operating the opening mechanism and the lift mechanism, wherein when the items are in the safe, the first panels are in the closed position substantially perpendicular to the second panels such that the first panels form the top wall of the second portion and the safe, and the lift mechanism is in a fully lowered position, wherein the guide tracks are provided above the top ends of the second panels; and b) activating the control system to activate the opening mechanism to pivot the first panels between the closed and open positions wherein to open and close the opening extending between the bottom of the first portion and the top ends of the second panels, and to activate the lift mechanism to raise the display platform with the items to a fully extended display portion so that the display portion with the items is adjacent the first portion and the items are on display.

16. The method of claim 15 wherein the control system includes a first limit switch and a second limit switch and wherein further in step (b) when the first panels reach the fully open position, the first limit switch is activated which deactivates the opening mechanism and the second limit switch is activated which activates the lift mechanism.

17. The method of claim 15 wherein further in step (b), as the display platform is raised, a surface of the display platform having the items remains parallel to a ground surface.

18. The method of claim 15 wherein a lock is provided to lock the first panels in the closed position and wherein further in step (b), when the control system is activated the lock is deactivated to unlock the first panels.

19. A method for moving items on display to a safe, which comprises the steps of:

a) providing a display case having a first portion having a top wall with an opposed bottom and opposed first sidewalls extending therebetween, and a second portion having an upper end connected to the first portion adjacent the bottom of the first portion and opposite the top wall of the first portion, the second portion having opposed first and second walls with second sidewalls extending therebetween, each second sidewall having a pair of opposed curvilinear guide tracks, the first and second walls each having a first panel, each first panel including a pin disposed in an associated guide track, and each panel being pivotably attached to a top end of a stationary second panel, with an opening mechanism connected to the first panels for pivoting the panels between an open position and a closed position and for enabling each pin to traverse its associated guide track, the first and second panels being parallel to one another when in the open position, the first and second panels being perpendicular to one another when in the closed position, wherein the first panels when in the open position have a respective top end adjacent to the bottom of the first portion of the display case, and the first panels in the closed position form an opening spaced between the top end of the second panels and the bottom of the display portion, and further wherein the first panels in the closed position form a top wall of the safe to provide unobstructed access through the opening, wherein the guide tracks are provided above the top ends of the second panels;

b) providing a lift mechanism mounted in the second portion;

c) providing a display platform connected to the lift mechanism for displaying the items;

d) providing a control system for operating the opening mechanism and the lift mechanism; and e) activating the control system to activate the lift mechanism to lower the display platform with the items to a fully lowered position in the second portion and activating the opening mechanism to pivot the first panels to the closed position so that the walls of the second portion form the safe and the display platform with the items is located in the safe.

20. A method for moving items on display to a safe, which comprises the steps of:

a) providing a display case having a first portion having a top wall with an opposed bottom and opposed first sidewalls extending therebetween, and a second portion connected to the first portion adjacent the bottom of the first portion and opposite the top wall of the first portion, the second portion having opposed first and second walls with second sidewalls extending therebetween, each second sidewall having a pair of opposed curvilinear guide tracks, the first and second walls each having a first panel being pivotably attached to a top end of a stationary second panel, each first panel including a pin disposed in an associated guide track for pivoting the first panels between an open position and a closed position, wherein the first panels form an upper section of the second sidewall when in the open position, and the first panels are configured in the closed position to provide an opening between the top end of the second panels and the bottom of the first portion of the display case, wherein the guide tracks are provided above the top ends of the second panels;

b) providing a lift mechanism mounted in the second portion;

c) providing a display platform connected to the lift mechanism for displaying the items;

d) providing an opening mechanism and a control system for operating the opening mechanism and the lift mechanism; and e) activating the control system to activate the lift mechanism to lower the display platform with the items to a fully lowered position in the second portion and activating the opening mechanism to pivot the first panels to the closed position essentially perpendicular to the second panels wherein during pivoting, a distance between the top of the first panels opposite the second panels and the bottom of the display portion increases and such that in the closed position, the first panels pivot from closing relation with the respective open spaces, form a top wall of the second portion of the display case and the bottom of the first portion of the display case and so that the walls of the second portion form the safe and the display platform with the items is located in the safe.

21. A display case which comprises:

a first portion having a top wall with an opposed bottom and opposed first sidewalls extending therebetween;

a second portion connected to the first portion adjacent the bottom of the first portion and opposite the top wall of the first portion, the second portion having opposed first and second walls with second sidewalls extending therebetween, each second sidewall having a pair of opposed curvilinear guide tracks, the first and second walls each having a first panel, each first panel including a pin disposed in an associated guide track, and each first panel being pivotably attached to a top end of a respective stationary second panel, an opening mechanism attached to the first panels for pivoting the first panels between an open position and a closed position, and the opening mechanism for enabling each pin to traverse its associated guide track, wherein each first panel is configured when in the open position to be substantially parallel to the respective stationary second panel and to form an upper half of a continuous wall extending to the bottom of the first portion, and each first panel is configured to pivot from the open position into the closed position to be substantially perpendicular to the respective stationary second panel and form a top wall of the second portion and provide an opening spaced between the top end of the respective stationary second panel and the bottom of the first portion of the display case, wherein the guide tracks are provided above the top ends of the second panels;

a lift mechanism mounted in the second portion;

a display platform connected to the lift mechanism for displaying the items; and a control system for operating the opening mechanism and the lift mechanism, wherein the control system is configured to activate the lift mechanism to lower the display platform with the items to a fully lowered position in the second portion and activating the opening mechanism to pivot the first panels to the closed position so that the walls of the second portion form the safe and the display platform with the items is located in the safe.

22. A display case which comprises:

a display portion having a top wall with an opposed bottom and opposed display sidewalls extending therebetween;

a safe portion having opposed first and second sidewalls each having a top end connected to the bottom of the display portion, and opposed lower panels extending between the first and second sidewalls, each first and second sidewall having a pair of opposed curvilinear guide tracks, each lower panel being stationary and having a top end spaced from the bottom of the display portion to form an unobstructed opening extending between the top ends of the lower panels and the bottom of the display portion, and a pair of upper panels having lower ends pivotably attached to the top end of a respective lower panel and adapted to pivot between an open position and a closed position, each upper panel including a pin disposed in an associated guide track, wherein the upper panels are configured in the open position to be substantially aligned with the respective lower panel to which attached, wherein the upper panels are configured to pivot from the open position into substantially perpendicular relation with the respective lower panel in the closed position, the upper panels close the opening in the closed position and form a top closure wall of the safe portion, and wherein the upper panels in the closed position provide unobstructed access through the opening;

an opening mechanism for moving the upper panels between the open and closed positions, and for enabling each pin to traverse its associated guide track;

a lift mechanism mounted in the safe portion;

a display platform connected to the lift mechanism; and a control system for controlling the opening mechanism and the lift mechanism.

* * * * *